United States Patent [19]

Tani et al.

[11] 4,296,597

[45] Oct. 27, 1981

[54] COTTON YARN-LIKE TEXTURED COMPOSITE YARN AND A PROCESS FOR MANUFACTURING THE SAME

[75] Inventors: Masayuki Tani; Mitsuhiko Okui; Mitsuo Matsumoto, all of Ibaraki, Japan

[73] Assignee: Teijin Limited, Osaka, Japan

[21] Appl. No.: 118,987

[22] Filed: Feb. 6, 1980

[30] Foreign Application Priority Data

Jul. 24, 1979 [JP] Japan ..... 54-93189

[51] Int. Cl.[3] ..... D02G 3/36; D02G 3/38

[52] U.S. Cl. ..... 57/205; 57/6; 57/226; 57/293

[58] Field of Search ..... 57/3, 6, 204, 205, 206, 57/207, 208, 210, 225, 226, 227, 230, 334, 244, 245, 248, 293

[56] References Cited

U.S. PATENT DOCUMENTS

| | | | |
|---|---|---|---|
| 3,041,812 | 7/1962 | Marshall | 57/207 X |
| 3,807,162 | 4/1974 | Ssuijita et al. | 57/205 |
| 3,921,382 | 11/1975 | Tsujita et al. | 57/205 X |
| 3,971,202 | 7/1976 | Windley | 57/205 |
| 4,164,839 | 8/1979 | Schweizer | 57/293 |

*Primary Examiner*—Donald Watkins

*Attorney, Agent, or Firm*—Burgess, Ryan and Wayne

[57] ABSTRACT

A textured composite yarn having the appearance and touch of a cotton yarn comprises a core yarn and a sheath yarn composed of a plurality of filaments, said sheath yarn wrapping around the core yarn. A part of the filaments of the sheath yarn wrap around the core yarn with a successive alternate twist and are substantially cohered and partially adhered to the core yarn. The composite yarn is made by simultaneous draw-false twisting and heating two component yarns having different fusing temperatures, one of the component yarns being overfed in relation to the other component yarn.

15 Claims, 11 Drawing Figures

COTTON YARN-LIKE TEXTURED COMPOSITE YARN AND A PROCESS FOR MANUFACTURING THE SAME

BACKGROUND OF THE INVENTION (1) Field of the Invention

The present invention relates to a textured composite yarn having the appearance and touch of a cotton yarn, and a process for the manufacture of the same.

(2) Description of the Prior Art

Already well known are various types of textured yarns, which are provided with a core portion with a hard touch and a surface portion with a soft touch. One of the above-mentioned yarns is manufactured by doubling and false-twisting two component multifilament yarns without fusion of the component yarns, one of the component yarns being of a different denier per filament than the other component yarn. As disclosed in Japanese Patent Publication No. 28018/70, another of the above-mentioned yarns is manufactured by false-twisting two component yarns having a different denier per filament from each other while one component yarn is wrapped on the other component yarn without the occurance of fusion of the component yarns.

Such conventional textured yarns are intended to provide a woolen-like textured yarn. They have a high bulkiness and a high elasticity, but a low stiffness.

According to Japanese Patent Publication No. 35588/75, a textured yarn is manufactured by false-twisting two component yarns whereby one component yarn is wrapped on the other component yarn and is heat-set at a very high temperature during the false-twisting process to fuse the component yarns. In such a textured yarn the core portion and the surface portion are fused together, or only the surface portion is fused. Consequently, the textured yarn has a high stiffness and an undesirable hard touch.

Further a common problem of the above-mentioned conventional textured yarn resides in that a core component yarn and a wrapping component yarn tend to slip from each other easily during use, because a core component yarn and a wrapping component yarn are not sufficiently integrated. As a result, the quality of the textured yarn is remarkably lowered.

With regard to the hand of the yarn, recently a natural hand, such as that of a cotton yarn, is especially preferred. However, the hand of a conventional filament yarn is completely different from that of a cotton yarn.

SUMMARY OF THE INVENTION

It is the primary object of the present invention to provide a textured composite yarn having the appearance and touch of a cotton yarn, but having none of the above-mentioned problems exhibited by the conventional textured composite yarn.

The second object of the present invention is to provide a textured composite yarn which is especially appropriate to use for a warp, said warp being a single yarn without additional cohesive properties.

The third object of the present invention is to provide a method for manufacturing a textured composite yarn having the appearance and touch of a cotton yarn, as mentioned above.

In our basic research to produce a textured composite yarn having the appearance and touch of a cotton yarn, it was comfirmed that if, in a false-twist textured composite yarn of a so called Core Yarn type (i.e. core-wrapper type), filaments in the core portion are cohered together by a partial fusion of the filament, while a sheath yarn is composed of filaments with two or less denier per filament, said filaments of the sheath yarn being partially cohered together by an interfacial fusion with the core yarn, i.e. by fusion of the core yarn at the boundary region where the core and sheath yarns meet, thereby resulting in a yarn that has a cotton yarn-like hand.

The primary object of the present invention can be attained by providing a false twist to a textured composite yarn having the appearance and touch of a cotton yarn, said textured composite yarn comprising a core yarn and a sheath yarn composed of a plurality of filaments, said sheath yarn wrapping around the core yarn at a ratio S the percentage of difference between the sheath yarn and the core yarn per unit length (hereinafter such ratio is referred to as a length difference ratio S) of at least 15%, a part of said component filaments of the sheath yarn wrapping on the core yarn with alternate S-Z twists in which alternate twists a wrapping angle of a helix of the S and Z twists is 360° or less than 360° (hereinafter such alternate twists being referred to as a successive alternate twist) while said part of filaments of the sheath yarn being substantially cohered and at least partially adhered to the core yarn by fusion at the boundary region wherein the filaments of the sheath yarn and the core yarn meet, and the remaining filaments of the sheath yarn being individually separate from each other and wrapping around the core yarn in a crimped state.

Further referring to the above-mentioned textured composite yarn, generally a cotton yarn has soft fluffs crowded around a main body portion, which portion is cohered by twisting and is hard, whereas a composite yarn of the present invention has a soft hand due to a length difference ratio of at least 15% and has an appropriate stiffness like that in the main body of a cotton yarn due to the partial fusion of core yarn. That is, according to the present invention, when a sheath yarn is longer than a core yarn by the ratio of at least 15%, the part of the component filaments of the sheath yarn wrap in a state, wherein part of the filaments are coherent, around the core yarn with successive alternate twists and partially adhere to the core yarn by fusion, thereby giving the finished yarn an appropriate stiffness, like a cotton yarn. However, the remaining component filaments of the sheath yarn are separate from each other and wrap in a crimped state around the core yarn, so that a soft hand, like a cotton yarn, can be obtained.

The second object of the present invention can be attained by providing a composite yarn, as mentioned-above, wherein the remaining component filaments of the sheath yarn wrap around the cohered and successive alternate twisted filaments in a S and Z twist opposite to the direction of the alternate twist of the cohered filaments, so that the cohered filaments of the sheath yarn and the remaining component filaments of the sheath yarn cross each other around the core yarn.

In the above-mentioned composite yarn of the present invention, component filaments of a sheath yarn form a laminated structure, wherein filaments of the inner layer cohere to each other and partially adhere to the core yarn and wrap around the core yarn with successive alternate twists, whereas filaments of the outer layer wrap comparatively tightly around the core yarn with alternate twists across the filaments of the inner layer. Although such a composite yarn seems to have only a hard hand, actually it has a soft hand, like a cotton yarn, because the porosity of the composite yarn is very high, i.e. the density of the composite yarn is very low. Such a high porosity is obtained because component filaments of the sheath yarn form a laminated structure and the filaments of the outer layer individually wrap around and cross the filaments of the inner layer.

The third object of the present invention can be attained by utilizing a method which comprises:

feeding a multifilament yarn (B) to a synthetic continuous filament yarn (A) having a break elongation of at least 70% in a false-twisted state;

wrapping the yarn (B) around the yarn (A) by use of rotational force of the yarn (A);

simultaneous draw-false twisting (i.e. in-draw texturing) the yarns (A) and (B) at a draw ratio of Rf from 1.1 through a value of the break elongation represented by the percentage of the yarn $(A)\times 0.01+0.8$;

fusing the yarn (A) in the state wherein the yarn (B) is wrapped around the yarn (A), and;

untwisting the yarns (A) and (B).

Other objects and advantages of the invention will become apparent from the following descriptions, taken in connection with the accompanying drawings.

BRIEF DESCRIPTION OF THE INVENTION

DETAILED DESCRIPTION OF THE PREFERRED EMBODIMENT

Figure 1:
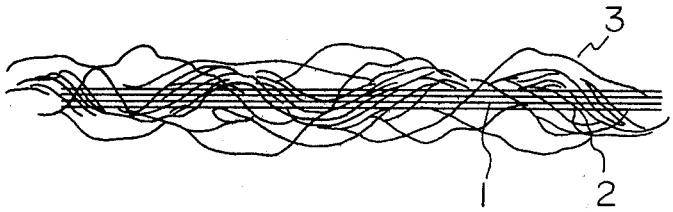
FIG. 1 is a schematic representation of a textured composite yarn according to the present invention.
Figure 2:
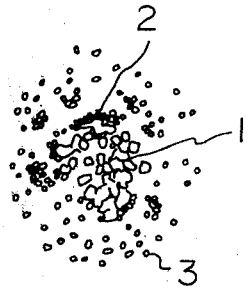
FIG. 2 is a schematic transverse sectional view of the textured composite yarn as shown in FIG. 1.

A composite yarn of the present invention comprises a core yarn composed of a continuous filament yarn and a sheath yarn composed of a multifilament yarn. Referring to FIGS. 1 and 2, component filaments of a core yarn 1 are fused at their surface and adhere to each other. Consequently, the core yarn in the composite yarn does not have a stretching property. A part 2 of the component filaments of the sheath yarn are at least partially adhered to the core yarn 1 due to fusion of the core yarn 1 at the boundary region, wherein the filaments of the sheath yarn and the filaments of the core yarn meet, and the sheath fibers are wrapped around the core yarn 1 with alternate S-Z twists, in which twists a wrapping angle of one helix of an S or a Z twist is 360° or less than 360°, so that the wrapping direction is successively reversed from the S twist to the Z twist and vice versa. The remaining filaments 3 of the sheath yarn are individually separate and are wrapped in a crimped state around the core yarn 1.

Generally speaking, a cotton spun yarn does not have a stretching property. The main body of the cotton spun yarn fibers are densly cohered by twisting and are stiff, but on the surface of the cotton yarn there are innumerable fluffs and such fluffs allow a soft hand.

According to a composite yarn of the present invention, a fused core yarn 1 and a part of the sheath yarn correspond to the main body of the cotton yarn and the individual crimped filaments 3 of the sheath yarn correspond to the fluffs of the cotton yarn.

As mentioned above, a composite yarn of the present invention is very similar to the hand of a cotton yarn. A woven fabric made of a composite yarn of the present invention is very similar in hand, tactile impression and appearance to fabric made from cotton yarn. Although a composite yarn of the present invention might seem to be unstable in structure, the composite yarn actually has such a stable structure that the core yarn and the sheath yarn will not separate from each other even if a considerablely large tension is imparted to the composite yarn.

The composite yarn can be produced by the following process. The process comprises over-feeding a yarn (B), composed of a multifilament, as a sheath yarn to a synthetic continuous filament yarn (A) having a break elongation of at least 70% in a false-twisted state; wrapping the yarn (B) around the yarn (A) by using a rotational force of the yarn (A), which rotational force is caused by false-twisting, simultaneously draw-false twising (i.e. in-draw texturing) said yarns at a draw ratio of Rf from 1.1 through a value of the break elongation represented by the percentage of the yarn $(A)\times 0.01+0.8$; heating the yarns (A) and (B) at a temperature higher than the fusing point of the yarn (A) and lower than the fusing point of the yarn (B) in a state that the yarn (B) is wrapped around the yarn (A), so that each component filament of the yarn (A) is fused at its surface portion and adheres to each other whereas a part of the component filaments of the yarn (B) partially adhere to the yarn (A) at the boundary region where the yarns (A) and (B) meet and the yarns (A) and (B) are heat set; and untwisting the heat-set integrated yarn and consequently taking-up the resulting yarn.

In order to make a composite yarn of the present invention effectively showing its features as mentioned before, i.e. having the appearance and touch of a cotton yarn, it is necessary to sufficiently overfeed the yarn (B) in relation with the yarn (A) for producing a difference in length between the yarns (A) and (B) at a ratio of at least 15%. In the case that a length difference ratio is more than 25%, a composite yarn having a more preferable appearance and hand touch can be obtained. In the case that a length difference ratio is in a range between 40% and 70%, a slightly excessive yarn-length of the yarn (B) is generated and, as a result, minute clumps or minute uneven portions are generated in the composite yarn, but the appearance of such a composite yarn is more similar to the appearance of a natural cotton yarn and is rather preferable. However, in the case that a length difference ratio is more than 70%, there are remarkable neps or slubs in the composite yarn and such a yarn is a kind of a fancy yarn.

Figure 5:
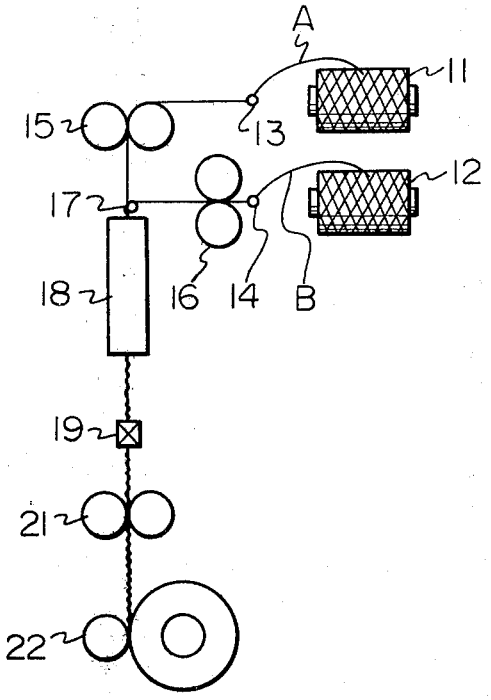
FIG. 5 is a diagrammatic representation of one embodiment of the process of the present invention.

Referring now to FIG. 5, a process for manufacturing a composite yarn of the present invention is explained. A synthetic filament yarn (A) composed of a plurality of filaments is fed by the first feed rollers 15 from a yarn package 11 via a yarn guide 13. The yarn (A) is to be a core yarn 1 of a resultant composite yarn. The yarn (A) coming from the feed rollers 15 is in a false-twisted state by a false-twist means 19, i.e. the yarn (A) is rotated. A yarn (B), which will become a sheath yarn, is fed from a yarn package 12 via a yarn guide 14 to the yarn (A) by the second feed rollers 16. The yarn (B) has a fusing temperature higher than that of the yarn (A) and is composed of a plurality of filaments, the fineness of each filament being less than 2 denier, preferably less than 1.0 denier, and the total finess of the filaments of the yarn (B) is in a range between 0.7 and 1.4 times that of the core yarn in a resultant composite yarn of the present invention, i.e. that of the yarn (A) after being drawn.

The yarn (B) is overfed in relation to the yarn (A) by means of the feed roller 16 and meets with the yarn (A) at a guide 17, so that the yarn (B) is wrapped around the yarn (A) and is false-twisted by the rotational force of the yarn (A). The yarn (A) and (B), now in a state where the yarn (B) is wrapped around the yarn (A), are put through a heater 18, which has a heating temperature high enough to fuse the component filaments of the yarn (A) at its surface but lower than the fusing temperature of the yarn (B). Downstream from the heater 18 there are provided a flase-twist means 19 and drawing roller 21. Consequently in the heating zone, the component filaments of the yarn (A) are partially fused to adhere to each other and simultaneously draw-false twisting takes place. As a result, a composite yarn emerging from the heater 18 has a fused core yarn and a sheath yarn, wherein a part of the filaments of the sheath yarn are wrapped on the core yarn with successive alternate S-Z twists these being the part of the filaments that are cohered and the remaing filaments of the sheath yarn are wrapped with crimping around the core yarn. The alternate twisted filaments of the sheath yarn are at least partially adhered to the core yarn, so that the structure of the composite yarn is stable. The resultant composite yarn is wound by a winding device 22.

As a false twist means 19 a hollow spindle type may be preferably used but any other type such as outer friction type, inner friction type may be used occasionally. Heater 18 may be contact type (plate heater) or non-contact type (pipe heater). Length of a heater is also to be taken into account, in relation to processing speed, yarn denier, etc.

In the process of the present invention, it is significant to use as a core yarn a synthetic continuous filament yarn having such a high break elongation that allows the yarn to be drawn. Also it is significant to simultaneously draw-false twist (i.e. in-draw texture) such a yarn having a high elongation between the first feed rollers 15 and the drawing rollers 21 while the yarn having a high elongation is being wrapped with a sheath yarn, thereby a helix of the wrapping sheath yarn is stretched due to simultaneous draw-false twisting and migration of filaments in the sheath yarn conspicuously takes place, so that filaments positioned in the outer portion of the sheath yarn are free from filaments with a successive alternate twist.

In a composite yarn as shown in FIG. 1, part of the filaments of the sheath yarn are wrapped on the core yarn 1 with successive alternate twists as one group of cohered filaments 2 and other filaments 3 free from the cohered filaments 2 crimp and wrap around the core yarn 1.

Figure 3:
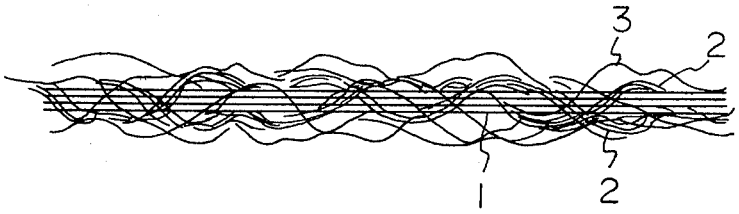
FIG. 3 is a schematic representation of another textured composite yarn of the present invention.

Another embodiment of a composite yarn produced by the same process as mentioned before is shown in FIG. 3. In this yarn, a part of the filaments of the sheath yarn are wrapped on the core yarn 1 with successive alternate twists as some groups of cohered filaments 2. The number of filaments in one group of the composite yarn, as shown in FIG. 3, is less than that of the composite yarn shown in FIG. 1. There are free filaments 3 in this composite yarn.

Figure 4:
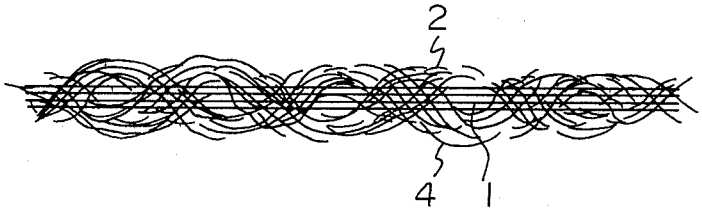
FIG. 4 is a schematic representation of a further textured composite yarn of the present invention.

FIG. 4 shows a modified embodiment of a composite yarn of the present invention, wherein free filaments in a sheath yarn do not crimp but individually wrap around the core yarn 1 with alternate S-Z twists. That is, part of the filaments 2 in the sheath yarn wrap around the core yarn 1 with alternate twists in a cohered state and at least partially adhere to the core yarn 1, whereas filaments 4 of the sheath yarn free from the coherent filaments 2 wrap as a group around the core yarn 1 and the coherent and adhered filaments 2 with alternate S-Z twists opposite to the alternate twist of the coherent and adhered filament 2. This means that then the group of free filaments 4 wrap with an S twist, the coherent and adhered filaments 2 wrap with a Z twist and vice versa, so that the filaments 4 cross the filaments 2. A feature to be noted of this composite yarn is that filaments of the sheath yarn composed of a multifilament yarn divide into two groups of filaments, 2 and 4, during the texturing process and form a laminated wrapping structure. Filaments 4 in the outer layer are different from the free filaments 3 of the composite yarn as shown in FIG. 1 or 3 in that the filaments 4 wrap as a group around the core yarn and around the coherent wrapping filaments 2 with an alternate twist without crimps, whereas the filaments 3 are individual and separate from the core yarn and the coherent filaments and have crimps. The filaments 4 form a stable wrapping structure. Therefore, the composite yarn as shown in FIG. 4 is suitable for being utilized as a warp yarn. When composite yarns of FIG. 4 are arranged in a row as warp yarns for a loom, no filaments of the composite yarn contact or become entangled with an adjacent yarn. Consequently, yarn brakage is not induced.

Figure 6:
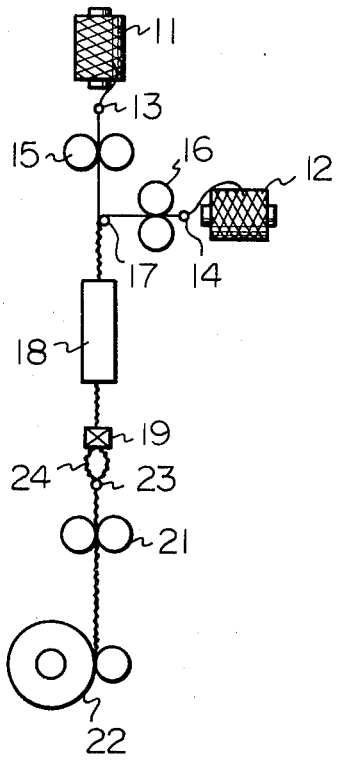
FIG. 6 is a diagrammatic representation of another embodiment of the process of the present invention.

Such a composite yarn, as shown in FIG. 4, is produced by a process as shown in FIG. 6, which is similar to the process shown in FIG. 5, except for the following point. That is, a yarn guide 23 is disposed between a false-twist means 19 and drawing rollers 21. The composite yarn is held at the false-twist means 19 and at the yarn guide 23 and forms a ballooning effect due to the rotation of the yarn. This ballooning occurs in such a manner that there is only one loop in the ballooning. The composite yarn is rotated by the above-mentioned one loop ballooning, while filaments of the sheath yarn in a free state, i.e. corresponding to filaments 3 in FIGS. 1 and 3, are firmly wrapped around the core yarn 1 and the coherent alternate twisted filaments 2 of the sheath yarn. Hereinafter, the wrapping of the free filaments is referred to as the second wrapping, and the wrapping of the coherent filaments is referred to as the first wrapping. The second wrapping forms as alternate twist which is different from that of the first wrapping phase.

It is important that only one loop is formed in the ballooning, in view of forming the second wrapping. In the case where more than one loop or less than one loop is formed in the ballooning, the second wrapping is not formed.

In order to obtain ballooning with only one loop, it is necessary to first operate temporarily a machine for carrying out the texturing process without using the yarn guide 23 under a predetermined texturing condition and to confirm the position of the first node of loops in the ballooning which node is formed just after the false twist means 19. Then the yarn guide 23 is disposed at the proper position in which the first node appears and then starts the texturing operation. The minimum amplitude of the ballooning is 3 mm and the length of the balloon is in a range between 5 mm and 15 mm.

A feature of the composite yarn produced by the above-mentioned process is that each filament of the sheath yarn migrates between the first wrapping portion (i.e. inner layer) and the second wrapping portion (i.e. outer layer). Consequently, the first wrapping portion and the second wrapping portion are firmly connected. The reason why such a firmly connected structure is obtained is that since free filaments are produced by the frequent migration of filaments caused by drawing during the simultaneous draw-false twisting step, a part of the filaments in a group forming the first wrapping portion are free from the group and become free filaments during the simultaneous draw-false twisting step and these filaments form the second wrapping portion becuase of the ballooning 24 which takes place after the false twist means 19.

According to the present invention, a yarn to be a core yarn 1 must have a high enough break elongation to allow the yarn to draw and false twist. Therefore the yarn should have a break elongation of at least 70%, preferably more than 100%.

In the case where the break elongation is less than 70%, it is difficult to carry out simultaneous draw-false twisting. Even if simultaneous draw-false twisting can be carried out, generation of free filaments decreases.

According to the present invention, the draw ratio must be at least 1.1 (i.e. elongation by drawing is at lease 10%). Preferably the draw ratio is more than 1.2 (i.e. elongation is more than 20%) and in this case the second wrapping portion is remarkably formed in a resultant composite yarn. However, when the draw ratio is too large the pitch of the helix in the wrapping portions gets too large and yarn brakage will occur during texturing. Thereofore, the draw ratio should be less than a value of the break elongation Rf of the core yarn (represented by %)$\times 0.01+0.8$. Preferably, the draw ratio should be less than the value of the break elongation $Rf\times 0.01+0.5$.

Figure 7:
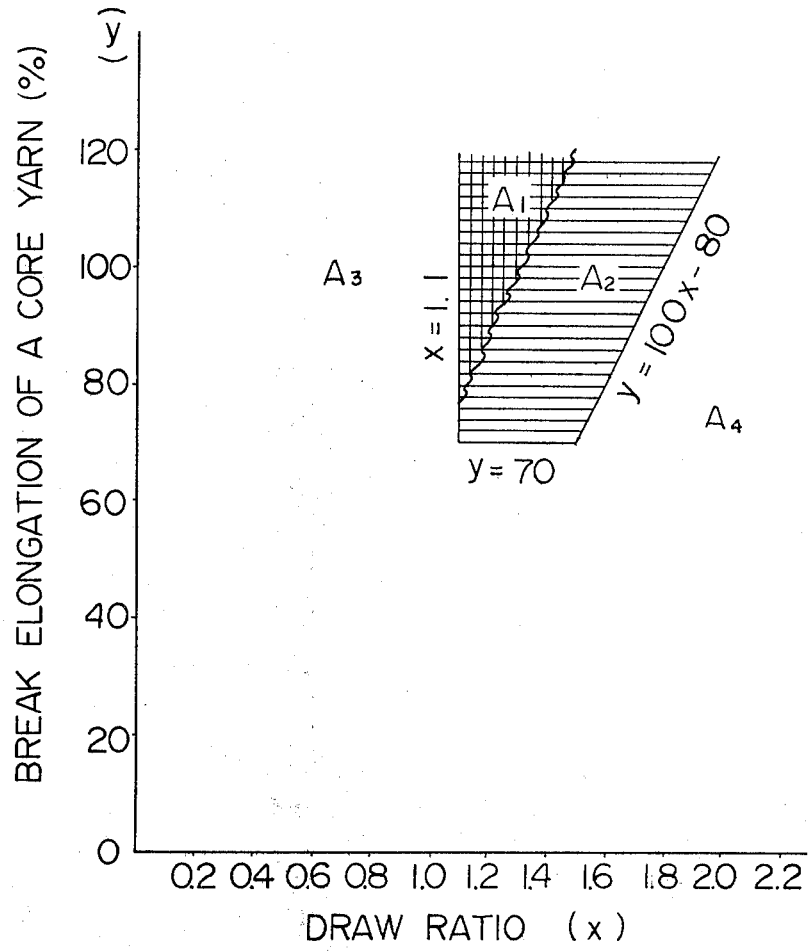
FIG. 7 is a graphical drawing showing the relationship between a break elongation of a core yarn and a draw ratio.

FIG. 7 shows the relationship between the draw ratio and elongation, and the range acceptable for utilizing the present invention when the break elongation of the core yarn is 70% or more than 70%. When a draw ratio and elongation is in areas $A_1$ and $A_2$, the process of the present invention can be carried out. However, in area $A_3$, since the core yarn is not sufficiently stretched, a desirable composite yarn is not formed. In this area the structure of a resultant composite yarn is different from that of a composite yarn of the present invention. In area $A_4$, since the draw ratio is too large, the wrapping of a sheath yarn is too rough. In area $A_5$, since the break elongation is too small, simultaneous draw-false twisting cannot be employed.

Preferably, a draw ratio should not exceed the natural draw ratio of the core yarn. Such a draw ratio is in a range of area $A_1$. In this case, the molecular chain in a core yarn is only partially orientated, so that molecular movement is comparatively high. Consequently, the core yarn is easily fused by heat in a false-twist and heat-set zone. On the other hand, the helixes of the wrapping portion of the sheath yarn are stretched during the simultaneous draw-false twist step, so that they wrap on the core yarn more tightly while at the same time the core yarn is being fused. As a result the core yarn and the sheath yarn are firmly integrated to become a composite yarn with a stable structure.

In connection with the above-mentioned step of the draw ratio, a yarn employed for a core yarn is preferably a partially oriented yarn produced by spinning at a high speed of more than 2500 m/min.

As a result of many experiments, the following items have been confirmed.

In order to obtain a textured composite yarn having the appearance and touch of a cotton yarn, a draw ratio Rf employed in a simultaneous draw-false twisting process is preferably in a range of the following limitation.

$$0.4Rn+0.6 \leqq Rf \leqq Rn$$

$R_n$: a natural draw ratio of a yarn to be a core yarn at room temperature

Further, in connection with a draw ratio, a ratio F of overfeeding a yarn (B), which is to become a sheath yarn, to a yarn (A) which is to become a core yarn, is preferably in a range of the following limitation.

$$(1.04Rf-1)\times 100 \leqq F \leqq (2.0Rf-1)\times 100$$

F: overfeeding ratio of feeding speed Ve of a yarn (B) to feeding speed Vc of a yarn (A)

$F=[(Ve-Vc)/Vc]\times 100(\%)$

Length difference ratio S has a relationship with the overfeeding ratio. Length difference ratio S is substantially determined by the following equation.

$$S=[(Ve-Vd)/Vd]\times 100(\%)$$

Vd: surface speed of a drawing roller

Draw ratio Rf is defined by the following equation.

$$Rf=(Vd)/(Vc)$$

Therefore, $$S=\left\{\left(\frac{F}{100}+1\right)\times\frac{1}{Rf}-1\right\}\times 100(\%)$$

In order to determine the preferable number and denier of filaments of a sheath yarn, an experiment was effected.

A partially oriented polyethylen terephthalate continuous filament yarn (115 denier/36 filaments, spinning speed 3200 m/min, a natural draw ratio $Rn=1.38$) was used for a core yarn. As a sheath yarn, fully drawn polyethylene terephthalate continuous filament yarns having a different denier per filament were employed. Fusing temperature of the yarn was in a range between 240° C. and 250° C. Conditions in the texturing process were as follows. Draw ratio Rf was 1.3, heating temperature was 240° C., overfeeding ratio F of a sheath yarn was 50%, and number of false twists was $$\frac{32500}{\sqrt{De}} \times 0.88.$$

The symbol "De" is defined as follows.

$$De = \frac{\text{total denier of a core yarn}}{\text{a draw ratio}} + \text{total denier of a sheath yarn.}$$

The result is shown in Table 1.

TABLE 1

| denier/filaments of a sheath yarn | denier of a filament | stability during texturing | stability of a resultant composite yarn | grade of a fabric made of a resultant composite yarn |
|---|---|---|---|---|
| 75/15 | 5.0 | Δ yarn breakage occurs often | X integration of a core yarn with a sheath yarn is not good | X rough and hard hand |
| 75/24 | 3.1 | Δ same as the above-mentioned | X same as the above-mentioned | X same as the above-mentioned |
| 75/36 | 2.1 | O | Δ or O | Δ or O |
| 50/36 | 1.4 | O | Δ or O | Δ or O |
| 50/48 | 1.0 | O | O | O |
| 60/144 | 0.42 | O | ◎ | ◎ |

Stability during texturing is classified as follows.

◎ : Excellent

O : Good

Δ: Acceptable

χ: Poor

The above rating applies also to "stability of a resultant composite yarn" and "grade of a fabric made of a resultant composite yarn" in Table 1.

As noticed from Table 1, a desirable fabric having a good hand is obtained when the denier of a filament in a sheath yarn is two denier or less. Also when the denier of a filament is two denier or less, a composite yarn having a desirable stability in structure is obtained. The hand of a fabric becomes remarkable when the number of filaments of a sheath yarn is 40 or more and the denier of a filament is 1.0 denier, more preferably when the number of filaments is 140 or more and the denier of a filament is 0.5 denier or less.

The total denier of a core yarn and the total denier of a sheath yarn are limited in view of the development of a particular structure of a composite yarn of the present invention during the texturing process and of the hand of the fabric made of a composite yarn. In the case where the total denier of a core yarn is too small in relation to that of a sheath yarn, the area of contact of the core yarn with the sheath yarn during texturing decreases, so that the sheath yarn does not substantially adhere to the core yarn. That is, in this case, adhesion and coherence of the sheath yarn at a boundary region wherein the sheath yarn and core yarn meet does not occur. As a result, the resultant composite yarn is a yarn like a conventional composite yarn composed of a fused core yarn and a wrapping yarn covering the surface of the core yarn. Such a composite yarn does not have a desirable hand.

However, in the case where the total denier of a core yarn is too large in relation to that of the sheath yarn, almost all the filaments of the sheath yarn will adhere to the core yarn, so that free filaments having crips to cover the core yarn are not produced. Consequently, a soft hand cannot be obtained.

After experimenting it was confirmed that when the total denier of a sheath yarn in a textured composite yarn is in a range between 0.7 and 1.4 to the total denier of the core yarn in the textured composite yarn, a desirable hand touch is obtained.

The most suitable example of a core yarn and a sheath yarn is a continuous filament yarn of ethylene terephthalate polyesters, but other material may be employed. For example, as a sheath yarn, antistatic polyester filaments which contain polyethlene glycol and/or alkali metal alkylsulfonates (metal salts of alkylsulfonic acids) can be employed.

Regarding the feeding means for a sheath yarn, the most suitable example is a nip roller means, as shown in FIGS. 5 and 6, to feed positively a sheath yarn by driving rollers, but a yarn tensor may be employed in place of a nip roller means. In this case, a sheath yarn is passively fed at a comparatively low constant tension.

Regarding the position wherein a sheath yarn meets a core yarn and starts wrapping around the core yarn, the position is acceptable when it is in a range between the feed rollers for the core yarn and the heater. In the case where the position is moved along the core yarn a very short distance, the resultant composite yarn has minute uneven portions, like minute knots, appearing in a cotton yarn.

The present invention will now be described in detail with reference to the following Examples, which by no means limit the scope of the present invention.

EXAMPLE 1

A partially oriented polyethlene terephthalate filament yarn, spun at a speed of 3200 m/min and composed of 115 denier/36 filaments, is used as a core yarn. A polyester filament yarn (65 denier/150 filaments) is employed as a sheath yarn. The fusing temperature of the polyester filament yarn is 250° C. The fusing temperature is defined as a temperature at which a yarn starts fusing, so that a part of the twists are not untwisted during the time the yarn is false-twist textured.

The above-mentioned core and sheath yarns were subjected to a simultaneous draw-false twist process in FIG. 5, under the following conditions.

(1) heater temperature: 238° C.

(2) number of false twists: 2400 T/m (3) texturing speed: 100 m/min (4) overfeeding ratio F: 80%

(5) draw ratio Rf: 1.3

(6) state of ballooning: none

In this draw ratio, the fusing temperature of the core yarn was in a range of 230° C. to 235° C.

Figure 8:
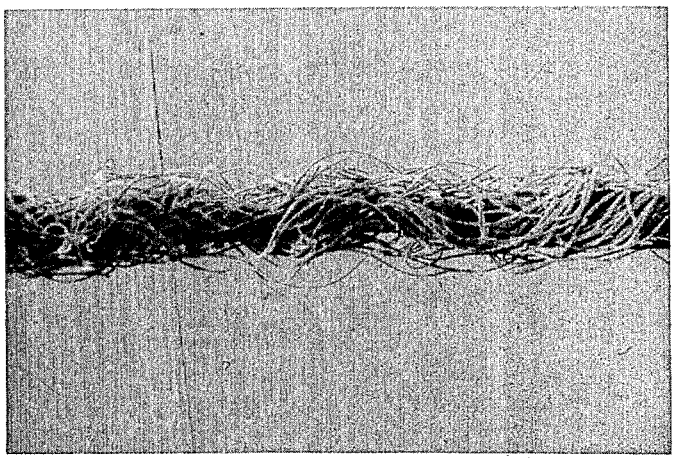
FIG. 8 is a photograph taken by a scanning electron microscope showing the textured composite yarn produced by the process of Example 1.
Figure 9:
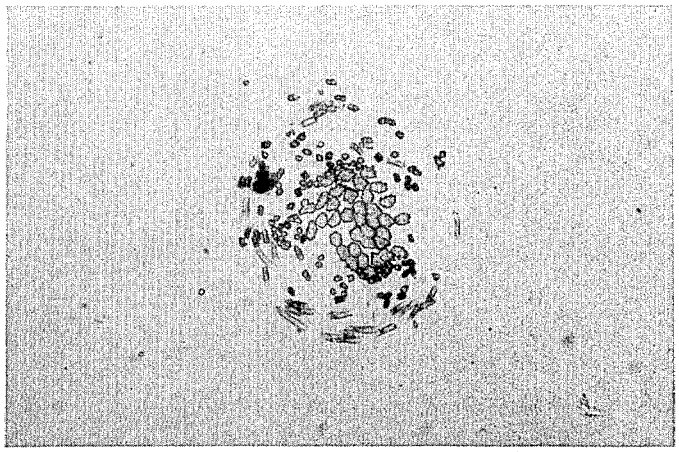
FIG. 9 is a photograph taken by a scanning electron microscope showing a transverse section of the yarn as shown in FIG. 8.

The resultant composite yarn had a typical yarn structure of the present invention, i.e. a three layer structure as shown in FIGS. 1 and 2. Photographs of this composite yarn similar to FIGS. 1 and 2 are respectively shown in FIGS. 8 and 9.

The length difference ratio was 38.5%. Break elongation of the composite yarn was 32%.

Although the composite yarn was strongly rubbed along its length, neps were not generated. Using the composite yarns as warp and weft yarns, a weaving operation was carried out smoothly without any trouble. The woven fabric had an appropriate stiffness and a soft hand on the surface of the fabric. The fabric was similar to a cotton fabric having a high quality.

EXAMPLE 2

The same filament yarns as mentioned in Example 1 were respectively employed as a core yarn and a sheath yarn. The texturing process as shown in FIG. 5 was employed under the following condition.

Figure 10:
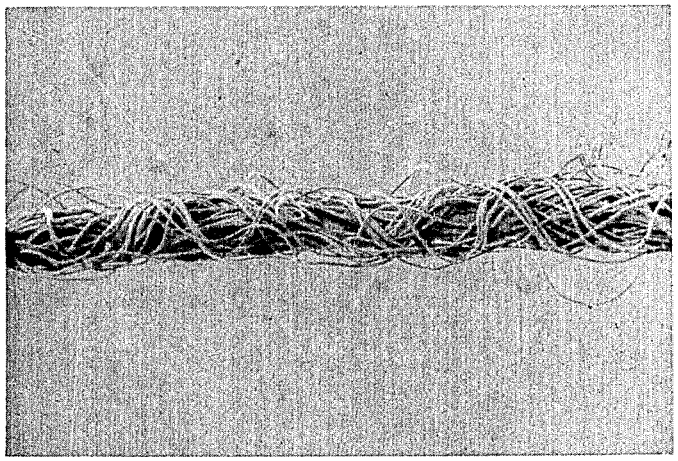
FIG. 10 is a photograph taken by a scanning electron microscope showing the textured composite yarn produced by the process of Example 2.

(1) heater temperature: 230° C.
(2) number of false twists: 2400 T/m
(3) texturing speed: 100 m/min
(4) overfeeding ratio: 75%
(5) draw ratio: 1.3
(6) amplitude of balloon: 2 mm
(7) length of balloon including 7 to 9 loops: 20 cm The resultant composite yarn showed another typical yarn structure of the present invention, as shown in FIG. 3. A photograph of the resultant composite yarn is shown in FIG. 10.

In this composite yarn, filaments of the core yarn were fused together. A part of the filaments of the sheath yarn formed some groups of successive alternate twisted coherent filaments. The number of filaments 2 in a group is comparatively less than that of the yarn in Example 1. Free crimped filaments 3 of the sheath yarn appearing in the composite yarn are more than those in composite yarn of Example 1. The composite yarn of Example 2 also showed a three layer structure. The length difference ratio was 35% and the break elongation of the composite yarn was 31%.

A fabric made of the composite yarns of Example 2 has a little less stiffness than that of the fabric made of the composite yarns of Example 1. A softer hand, like a soft hand due to fluffs in a cotton fabric, is obtained in this fabric.

EXAMPLE 3

A partially oriented polyester filament yarn (115 denier/24 filaments), dyeable with cationic dye and spun at a speed of 3000 m/min, was used as a core yarn. A polyester filament yarn (75 denier/72 filaments) having a fusing temperature of 250° C. was used as a sheath yarn. These yarns were subjected to texturing process as shown in FIG. 5 under the following conditions.

(1) heater temperature: 230° C.
(2) number of false twists: 2350 T/m
(3) texturing speed: 80 m/min
(4) overfeeding ratio: 70%
(5) draw ratio: 1.2

In this draw ratio, the fusing temperature of the core yarn was in a range of 225° to 230° C.

The resultant composite yarn has a three-layer structure as shown in FIG. 2.

A woven fabric produced by the composite yarns of Example 3 has a soft hand, like a cotton fabric.

EXAMPLE 4

The same filament yarns as mentioned in Example 1 were respectively employed as a core yarn and a sheath yarn. The texturing process as shown in FIG. 6 was employed with following conditions.

(1) heater temperature: 238° C.
(2) number of false twists: 2400 T/m
(3) texturing speed: 100 m/min
(4) overfeeding ratio F: 80%
(5) draw ratio Rf: 1.3
(6) amplitude of balloon: 5 mm
(7) length of balloon including only one loop: 13 mm Under the above-mentioned draw ratio, the fusing temperature of the core yarn was about in a range of 230° C. to 235° C.

The resultant composite yarn included a typical yarn structure of the present invention, as shown in FIG. 4, and such a structure occurred in about 60% of the total yarn.

The length difference ratio was 38.5% and the break elongation of the composite yarn was 32%.

Figure 11:
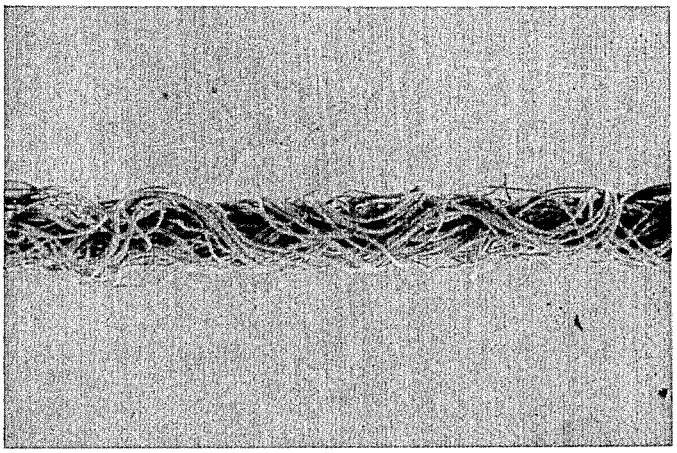
FIG. 11 is a photograph taken by a scanning electron microscope showing the textured yarn produced by the process of Example 4.

A photograph of the composite yarn is shown in FIG. 11.

The composite yarn was strongly rubbed along its length; nevertheless neps were not generated. Using the composite yarns, a weaving operation was carried out smoothly without any trouble. The obtained fabric had an appropriate stiffness and a soft hand at the surface of the fabric. The fabric was similar to a cotton fabric having a high quality.

In the case where the composite yarns were used as warp yarns arranged at a density of 21 yarns/cm and a "Woolie" textured yarn was used as a weft yarn, yarn breakage of the warp due to mutal entanglement of adjacent ends happened only 0.2 time/hour.

EXAMPLE 5

The same yarns as mentioned in Example 1 were used as a core yarn and a sheath yarn, respectively. The yarns were subjected to a texturing process as shown in FIG. 6 under the following conditions.

(1) heater temperature: 230° C.
(2) number of false twists: 2400 T/m
(3) texturing speed: 100 m/min
(4) overfeeding ratio F: 75%
(5) draw ratio: 1.3
(6) amplitude of balloon: 5 mm
(7) length of balloon including only one loop: 10 mm The resultant composite yarn had a similar yarn structure as shown in FIG. 4. In this composite yarn; the length difference ratio was 35%, and the break elongation was 31%.

A fabric made of this composite yarn had a suitable stiffness and a soft hand, like that obtained by fluffs in a cotton yarn.

What is claimed is:

1. A false twist textured composite yarn having the appearance and touch of a cotton yarn, said textured composite yarn comprising a core yarn and a sheath yarn composed of a plurality of filaments, said sheath yarn wrapping around the core yarn with a length difference ratio of at least 15%, wherein a part of said filaments of the sheath yarn wrap around the core yarn with a successive alternate twist, while said part of filaments being substantially cohered and at least partially adhered to the core yarn by fusion of the core yarn at the boundary region where the component filaments of the sheath yarn and the core yarn meet, and the remaining component filaments of the sheath yarn being individually separate from each other wrap around the core yarn and the coherent filaments while the remaining filaments are in a crimped state, so that a three-layer structure is formed.

2. A textured composite yarn according to claim 1, wherein the remaining component filaments of the sheath yarn wrap around the coherent and successive alternate twisted filaments of the sheath yarn while the wrapping direction of the remaining component filaments is opposite to that of the alternate twist of the coherent filaments, so that the coherent component filaments of the sheath yarn and the remaining component filaments of the sheath yarn cross each other around the core yarn to form a laminated wrapping portion.

3. A textured composite yarn according to claim 1 or 2 wherein the component filaments of the sheath yarn migrate between the layers formed by the sheath yarn.

4. A textured composite yarn according to claim 1 wherein a filament of the sheath yarn is 1 denier or less.

5. A textured composite yarn according to claim 1 wherein the number of component filaments of the sheath yarn is at least 40.

6. A textured composite yarn according to claim 1 wherein a ratio of the total denier of the sheath yarn to the total denier of the core yarn is in a range between 0.7 and 1.4.

7. A textured composite yarn according to claim 1 wherein there are groups of substantially coherent filaments in the sheath yarn.

8. A textured composite yarn according to claim 1 wherein the sheath yarn is a polyester filament yarn.

9. A textured composite yarn according to claim 1 wherein the core yarn is a polyester filament yarn.

10. A textured composite yarn according to any one of claims 1 through 9 wherein the break elongation of the composite yarn is at least 30%.

11. A process for producing a composite yarn comprising over feeding a multifilament yarn (B) to a synthetic continuous filament yarn (A) having a break elongation of at least 70% in a false-twisted state; wrapping the yarn (B) around the yarn (A) by use of rotational force of the yarn (A); similtaneous draw-false twisting (i.e. in-draw texturing) the yarns (A) and (B) at a draw ratio of (Rf) from 1.1 through a value of the break elongation represented by percentage of the yarn $(A)\times 0.01+0.8$; fusing the yarn (A) in the state wherein the yarn (B) is wrapped around the yarn (A); and untwisting the yarns (A) and (B).

12. A process according to claim 11 wherein a draw ratio is determined as a natural draw ratio of the yarn (A) or below.

13. A process according to claim 10 or 11 wherein the overfeeding ratio is in a range that is defined as follows:

$$(1.04Rf-1)\times 100 \leqq F \leqq (2.0Rf-1)\times 100$$

note;

F: overfeeding ratio of feeding speed Ve of the yarn (B) to feeding speed Vc of the yarn (A)

$$F=[(Ve-Vc)/Vc]\times 100\%$$

Rf: draw ratio

14. A process according to claim 11 wherein the amplitude of a balloon generated during untwisting is at least 3 mm.

15. A process according to claim 11 wherein the length of a loop of a balloon generated during untwisting is in a range between 5 mm and 15 mm.

* * * * *

UNITED STATES PATENT AND TRADEMARK OFFICE

CERTIFICATE OF CORRECTION

PATENT NO. : 4,296,597

DATED : October 27, 1981

INVENTOR(S) : Masayuki Tani, et al

It is certified that error appears in the above—identified patent and that said Letters Patent is hereby corrected as shown below:

Column 1, line 25: "occurance" should be --occurrence--.

Column 4, line 14: "densly" should be --densely--.
lines 30-31: "considerablely" should be --considerably--.

Column 5, line 34: "flase" should be --false--.

Column 6, line 51: "brakage" should be --breakage--.

Column 7, line 34: "becuase" should be --because--.
line 52: "brakage" should be --breakage--.

Column 8, line 62: "polyethylen" should be --polyethylene--.

Column 9, line 68: "crips" should be --crimps--.

Column 10, line 12: "polyethlene" should be --polyethylene--.
line 49: "polyethlene" should be --polyethylene--.

Column 14, line 9: "similtaneous" should be --simultaneous--.

Signed and Sealed this

*Fourteenth* Day of *December 1982*

[SEAL]

*Attest:*

GERALD J. MOSSINGHOFF

*Attesting Officer*

*Commissioner of Patents and Trademarks*